US008824244B2

(12) United States Patent
Kato et al.

(10) Patent No.: US 8,824,244 B2
(45) Date of Patent: Sep. 2, 2014

(54) RADIO-CONTROLLED WRISTWATCH

(75) Inventors: Akira Kato, Sayama (JP); Takushi Hagita, Tokorozawa (JP)

(73) Assignees: Citizen Holdings Co., Ltd., Tokyo (JP); Citizen Watch Co., Ltd, Tokyo (JP)

( * ) Notice: Subject to any disclaimer, the term of this patent is extended or adjusted under 35 U.S.C. 154(b) by 0 days.

(21) Appl. No.: 14/008,403

(22) PCT Filed: Mar. 13, 2012

(86) PCT No.: PCT/JP2012/056396

§ 371 (c)(1),
(2), (4) Date: Sep. 27, 2013

(87) PCT Pub. No.: WO2012/132875

PCT Pub. Date: Oct. 4, 2012

(65) Prior Publication Data

US 2014/0016440 A1 Jan. 16, 2014

(30) Foreign Application Priority Data

Mar. 30, 2011 (JP) ..... 2011-076736

(51) Int. Cl.
*G04C 11/02* (2006.01)
*G04R 20/10* (2013.01)
*G04R 20/04* (2013.01)

(52) U.S. Cl.
CPC ..... *G04R 20/04* (2013.01); *G04R 20/10* (2013.01)
USPC ..... 368/47

(58) Field of Classification Search
USPC ..... 368/46–47, 64, 76, 14, 10, 13, 185, 55, 368/276, 278
See application file for complete search history.

(56) References Cited

U.S. PATENT DOCUMENTS

| | | | | |
|---|---|---|---|---|
| 7,102,964 | B2 * | 9/2006 | Fujisawa | 368/66 |
| 7,859,947 | B2 * | 12/2010 | Kawai | 368/10 |
| 2007/0276593 | A1 | 11/2007 | Mutoh | |
| 2009/0180356 | A1 | 7/2009 | Fujisawa | |
| 2011/0063952 | A1 * | 3/2011 | Baba | 368/47 |

FOREIGN PATENT DOCUMENTS

| | | | |
|---|---|---|---|
| JP | 08-22422 | A | 1/1996 |
| JP | 2000-065913 | A | 3/2000 |

(Continued)

OTHER PUBLICATIONS

International Search Report of PCT/JP2012/056396 dated Apr. 24, 2012.

*Primary Examiner* — Edwin A. Leon
(74) *Attorney, Agent, or Firm* — Sughrue Mion, PLLC

(57) ABSTRACT

Provided is a radio-controlled wristwatch that receives a radio wave including day-related information from a satellite within a global positioning system, in which a cycle number of the day-related information is correctly updated even in a case where a power supply voltage drops. A radio-wave wristwatch (1) according to the present invention includes: reception means (11) for receiving a radio wave from a satellite and extracting day-related information therefrom; timekeeping-circuit halting means for halting an operation of a timekeeping circuit based on a power supply voltage; timekeeping-circuit halt detection means for detecting that the operation of the timekeeping circuit (13) has been halted by the timekeeping-circuit halting means; a nonvolatile memory (23) for storing the day-related information and a cycle number of the day-related information; and cycle-number updating means for updating, when the timekeeping-circuit halt detection means detects that the operation of the timekeeping circuit has been halted, the cycle number of the day-related information based on a comparison result between the day-related information extracted by the reception means (11) and the day-related information stored in the nonvolatile memory (23).

13 Claims, 7 Drawing Sheets

(56) References Cited

FOREIGN PATENT DOCUMENTS

| | | | |
|---|---|---|---|
| JP | 2000-352583 | A | 12/2000 |
| JP | 3614713 | B2 | 1/2005 |
| JP | 2007-315953 | A | 12/2007 |
| JP | 2009-168620 | A | 7/2009 |
| JP | 2009-250801 | A | 10/2009 |

* cited by examiner

SUBFRAME 1

| WORD | BIT POSITION | BIT COUNT | CONTENTS | |
|---|---|---|---|---|
| 1 | 1 | 22 | TLM | TELEMETRY WORD |
| 2 | 31 | 22 | HOW | HANDOVER WORD |
| 3 | 61 | 10 | WN | WEEK NUMBER |
| | 73 | 4 | URA | DISTANCE MEASUREMENT PRECISION |
| | 77 | 6 | SVhealth | SATELLITE HEALTH STATE |
| | 83 | 2 MSB | 10DC | CLOCK INFORMATION NUMBER |
| 7 | 197 | 8 | TGD | GROUP DELAY |
| 8 | 211 | 8 LSB | 10DC | CLOCK INFORMATION NUMBER |
| | 219 | 16 | toc | EPOCH TIME (CLOCK) |
| 9 | 241 | 8 | af2 | CLOCK CORRECTION FACTOR |
| | 249 | 16 | af1 | CLOCK CORRECTION FACTOR |
| 10 | 271 | 22 | af0 | CLOCK CORRECTION FACTOR |

FIG.5

SUBFRAME 4, PAGE 18

| WORD | BIT POSITION | BIT COUNT | CONTENTS | |
|---|---|---|---|---|
| 1 | 1 | 22 | TLM | TELEMETRY WORD |
| 2 | 31 | 22 | HOW | HANDOVER WORD |
| 3 | 63 | 6 | SV ID | PAGE ID=56 |
| | 69 | 8 | $\alpha_0$ | IONOSPHERIC CORRECTION FACTOR |
| | 77 | 8 | $\alpha_1$ | IONOSPHERIC CORRECTION FACTOR |
| 4 | 91 | 8 | $\alpha_2$ | IONOSPHERIC CORRECTION FACTOR |
| | 99 | 8 | $\alpha_3$ | IONOSPHERIC CORRECTION FACTOR |
| | 107 | 8 | $\beta_0$ | IONOSPHERIC CORRECTION FACTOR |
| 5 | 121 | 8 | $\beta_1$ | IONOSPHERIC CORRECTION FACTOR |
| | 129 | 8 | $\beta_2$ | IONOSPHERIC CORRECTION FACTOR |
| | 137 | 8 | $\beta_3$ | IONOSPHERIC CORRECTION FACTOR |
| 6 | 151 | 24 | $A_1$ | UTC PARAMETER |
| 7 | 181 | 24 MSB | $A_0$ | UTC PARAMETER |
| 8 | 211 | 8 LSB | | |
| | 219 | 8 | $T_{ot}$ | EPOCH TIME (UTC) |
| | 227 | 8 | $WN_t$ | |
| 9 | 241 | 8 | $\Delta t_{LS}$ | CURRENT LEAP SECOND |
| | 249 | 8 | $WN_{LSF}$ | WEEK IN WHICH LEAP SECOND IS UPDATED |
| | 257 | 8 | DN | DAY ON WHICH LEAP SECOND IS UPDATED |
| 10 | 271 | 8 | $\Delta t_{LSF}$ | UPDATED LEAP SECOND |

FIG.6

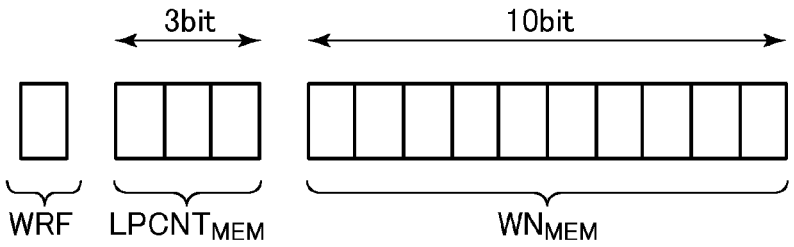

RADIO-CONTROLLED WRISTWATCH

CROSS REFERENCE TO RELATED APPLICATIONS

This is a National Stage International Application No. PCT/JP2012/0456396 filed Mar. 13, 2012, claiming priority based on Japanese Patent Application No. 2011-076736 filed Mar. 30, 2011, the contents of all which are incorporated herein by reference in their entirety.

TECHNICAL FIELD

The present invention relates to a radio-controlled wristwatch.

BACKGROUND ART

In recent years, as a wristwatch, a so-called radio-controlled timepiece that receives an external radio wave including time information and corrects a time retained internally is becoming widespread. In general, the radio wave received by the radio-controlled timepiece is a long-wave-band radio wave called a "standard wave", and has a disadvantage of geographical limitations and a long time required for reception due to use of a low-frequency carrier wave.

In contrast, there is proposed a radio-controlled wristwatch that receives an ultra high frequency used in a global positioning system represented by the Global Positioning System (GPS). For example, Patent Literature 1 discloses a wristwatch with the GPS that receives a satellite signal from a GPS satellite and corrects the time based on GPS time information included in the satellite signal.

Further, Patent Literature 2 discloses a car navigation device that receives the satellite signal from the GPS satellite, in which a current cycle number of WN is detected by referring to a cycle number of WN recorded in a map information recording medium or leap second information.

CITATION LIST

Patent Literature

[Patent Literature 1] JP 2009-168620 A
[Patent Literature 2] JP 3614713 B

SUMMARY OF INVENTION

Technical Problem

In a GPS, information on a day/time is formed of a number of a week called "Week Number" (WN) and information relating to a current time called "Time Of Week" (TOW; also referred to as "Z count"). Here, WN is a value incremented by 1 every week and having only a 10-bit information amount, and therefore causes an overflow to be reset to 0 after the lapse of 1,024 weeks. Therefore, in weeks whose number is a multiple of 1,024 weeks after Jan. 6, 1980, when timekeeping for GPS time was started, the same WN is again transmitted from a GPS satellite. This phenomenon has taken place once so far, on Aug. 21, 1999. WN will cause an overflow the next time on Apr. 6, 2019 (above mentioned times are in GPS time).

Therefore, a current date cannot be known accurately only by the information on the day/time received from the GPS satellite. For that reason, without being separately provided with a mechanism for storing a cycle number of WN, a radio-wave wristwatch that receives a satellite signal from the GPS satellite cannot be provided with a function of displaying a date, a day of the week or a perpetual calendar across a day/time during which there is an overflow of WN.

Here, in a case of, for example, a GPS receiver such as a car navigation system, as in Patent Literature 2, it is possible to notify the system of the most recent cycle number of WN at a time of an update of map information performed on a regular or irregular basis. However, it is difficult to issue such a notification to a wristwatch. For that reason, the wristwatch itself needs to store and retain the cycle number of WN internally and update the cycle number of internal WN when the overflow of WN occurs. However, the wristwatch may fail to update the cycle number of WN at when the overflow of WN occurs, if its battery is not charged for a long time, or its timekeeping circuit is halted due to a drop in power supply voltage, caused by a drop in charging voltage or the like if the wristwatch uses a secondary battery.

Note that the above discussion applies not only to GPS operated by the United States of America but also to other global positioning systems existing at the present time or to be built in the future, as long as they have specifications that practically cause the overflow due to a small amount of information being allocated to day-related information. Accordingly, although the present invention is hereinafter described by using WN in conformance with GPS, this WN is not necessarily limited to week information, but can be read as the day-related information.

The present invention has been made in view of such circumstances, and an object thereof to be achieved is a radio-wave wristwatch that receives a radio wave including day-related information from a satellite within a global positioning system, in which a cycle number of the day-related information is correctly updated even in a case where a power supply voltage drops.

Solution to Problem

In order to solve the above-mentioned problem, a radio-controlled wristwatch according to the present invention includes: reception means for receiving a radio wave from a satellite and extracting day-related information therefrom; timekeeping-circuit halting means for halting an operation of a timekeeping circuit based on a power supply voltage; timekeeping-circuit halt detection means for detecting that the operation of the timekeeping circuit has been halted by the timekeeping-circuit halting means; a nonvolatile memory for storing the day-related information and a cycle number of the day-related information; and cycle-number updating means for updating, when the timekeeping-circuit halt detection means detects that the operation of the timekeeping circuit has been halted, the cycle number of the day-related information based on a comparison result between the day-related information extracted by the reception means and the day-related information stored in the nonvolatile memory.

Advantageous Effects of Invention

According to the present invention, it is possible to achieve the radio-controlled wristwatch that receives a radio wave including day-related information from a satellite within a global positioning system, in which the cycle number of the day-related information is correctly updated even in the case where the power supply voltage drops.

BRIEF DESCRIPTION OF DRAWINGS

[FIG. 5] A diagram illustrating a structure of a page 18 of a subframe 4.

[FIG. 6] A diagram illustrating information retained in a memory.

DESCRIPTION OF EMBODIMENT

Figure 1:
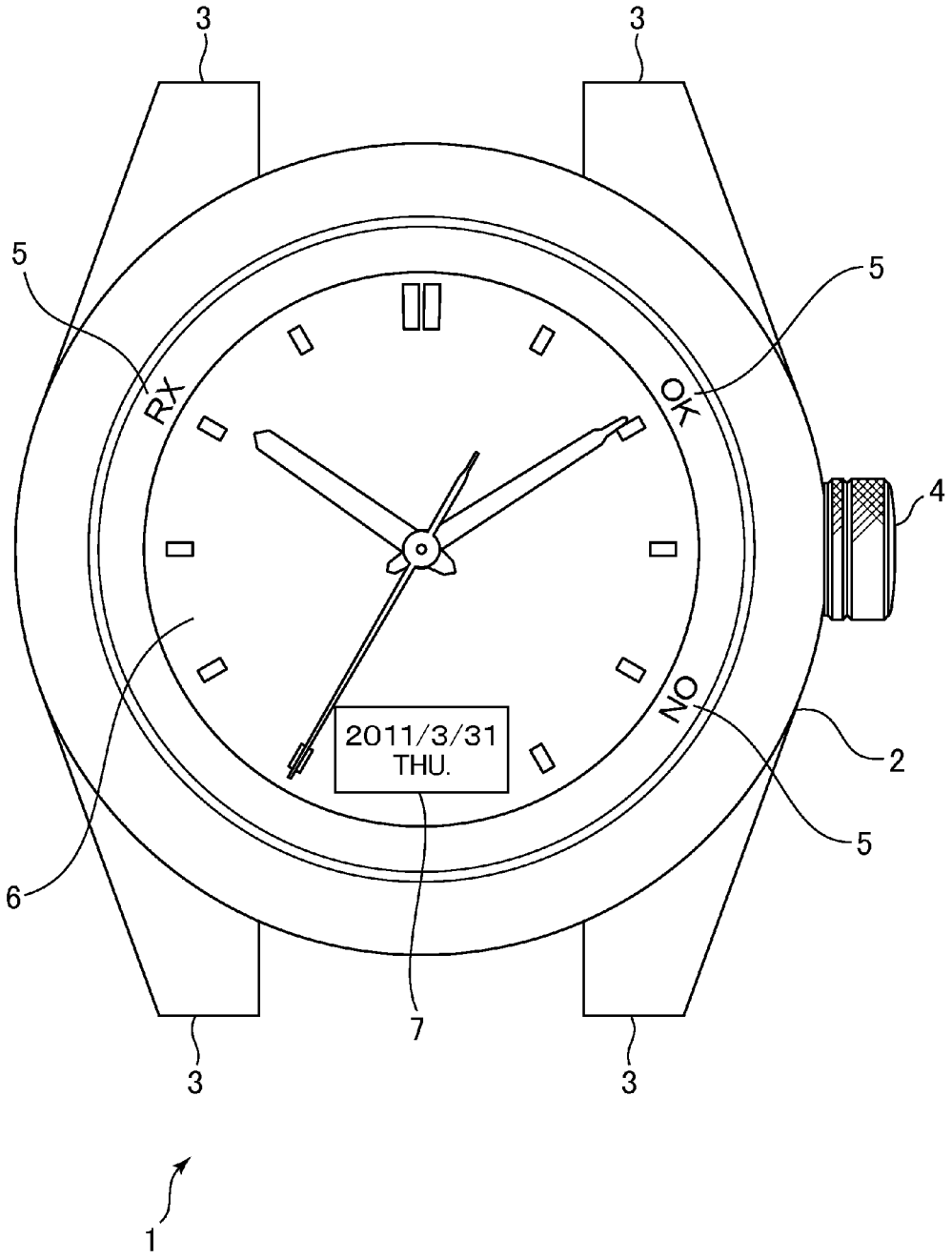
[FIG. 1] A plan view illustrating a radio-controlled wristwatch according to an embodiment of the present invention.

FIG. 1 is a plan view illustrating a radio-controlled wristwatch 1 according to an embodiment of the present invention. Here, a radio-controlled wristwatch represents a wristwatch serving as a radio-controlled timepiece.

In the figure, reference numeral 2 denotes an outer case, which is provided with band attachment units 3 at a 12 o'clock position and a 6 o'clock position thereof. Further, a crown 4 is provided on a 3 o'clock side surface of the radio-controlled wristwatch 1. Note that in the same figure, a 12 o'clock direction of the radio-controlled wristwatch 1 corresponds to an upward direction in the figure, and a 6 o'clock direction corresponds to a downward direction in the figure.

The radio-controlled wristwatch 1 uses hands as illustrated in the figure, and is provided with an hour hand, a minute hand, and a second hand coaxially about a center position of the radio-controlled wristwatch 1. Note that in this embodiment, the second hand is coaxial with the hour hand, but by replacing the second hand with a so-called chrono hand as in a chronograph timepiece, the second hand may be placed in an arbitrary position as a secondary hand. Further, indications 5 for informing a user of a reception state are inscribed or printed on the outer case 2 at positions outside a dial 6. The second hand points at any one of those indications 5 during and before/after reception of a radio wave including time information received from an artificial satellite of a global positioning system, or in this embodiment, GPS. Further, a digital display unit 7 is provided at the 6 o'clock position of the dial 6 so that the date displayed thereon can be visually recognized. In this embodiment, the digital display unit 7 is a liquid crystal display device, and can display various kinds of information other than a year/month/day and a day of the week illustrated in the figure. However, such display is merely an example, and appropriate analog display, for example, the display of the day and the day of the week using a day dial and other such rotational disc and various kinds of display using the secondary hand, may be used in place of the digital display unit 7. In either case, the radio-controlled wristwatch 1 retains information on not only a current time but also on a current date, at least internally.

Further, the radio-controlled wristwatch 1 according to this embodiment includes a patch antenna as an antenna for high-frequency reception at a 9 o'clock side position on a back side of the dial 6. Note that a format of the antenna may be determined depending on the radio wave to be received, and an antenna having another format, for example, an inverted-F antenna, may be used.

Figure 2:
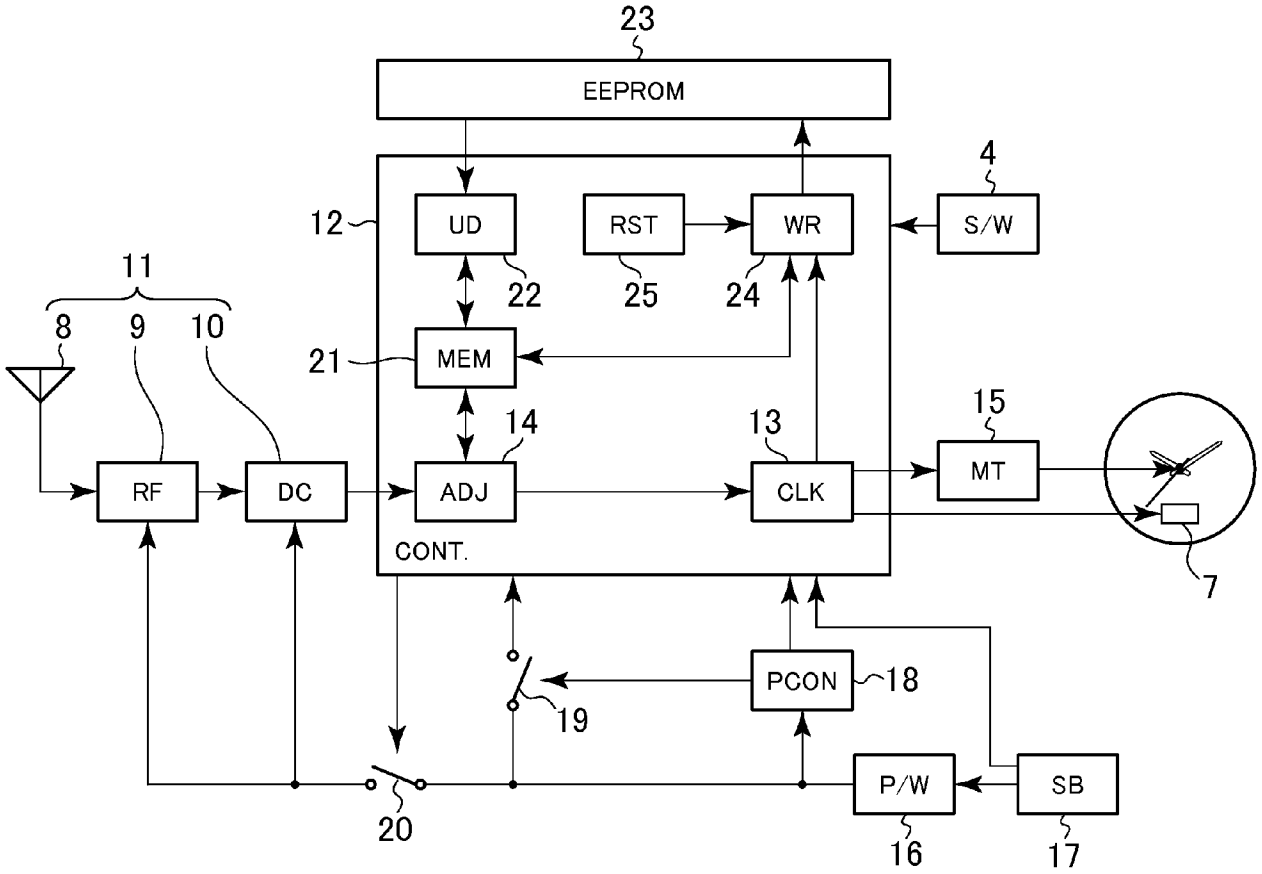
[FIG. 2] A functional block diagram of the radio-controlled wristwatch according to the embodiment of the present invention.

FIG. 2 is a functional block diagram of the radio-controlled wristwatch 1 according to this embodiment. The radio wave received from a GPS satellite by an antenna 8 is converted into a baseband signal by a high-frequency circuit 9, and TOW or WN being information relating to the time, or $\Delta t_{LS}$ being information relating to a current leap second as necessary, is extracted therefrom by a decoding circuit 10 and passed over to a controller 12. That is, the antenna 8, the high-frequency circuit 9, and the decoding circuit 10 constitute reception means for receiving the radio wave from a satellite and extracting WN, being day-related information, therefrom.

The controller 12 is a microcomputer for controlling an overall operation of the radio-wave wristwatch 1, and by including a timekeeping circuit 13 internally has a function of keeping time for an internal time, being a time retained by the timekeeping circuit 13. Precision of the timekeeping circuit 13, which depends on precision of a quartz resonator used and a usage environment such as a temperature, is to a lunar inequality of approximately ±15 seconds. It is natural that the precision may be arbitrarily set as necessary. Further, the internal time retained by the timekeeping circuit 13 is appropriately corrected by a time correcting circuit 14 based on TOW, WN, or $\Delta t_{LS}$ extracted by reception means 11, thereby being kept accurate.

The controller 12 inputs a signal from input means (crown 4) for receiving an operation performed externally by the user or the like. Further, the controller 12 outputs a signal for driving a motor 15 based on the internal time, thereby driving the hands to display the time, and outputs the information to be displayed on the digital display unit 7, for example, the current year/month/day and day of the week.

Further, the radio-controlled wristwatch 1 according to this embodiment is provided with a secondary battery 16 as a power supply therefore, and accumulates power obtained from power generation performed by a solar battery 17 placed on or under the dial 6 (see FIG. 1). Then, the power is supplied from the secondary battery 16 to the high-frequency circuit 9, the decoding circuit 10, and the controller 12.

A power supply circuit 18 monitors an output voltage from the secondary battery 16, and if the output voltage from the secondary battery 16 drops below a predefined threshold value, turns off a switch 19 to stop the power supply to the controller 12. Then, the power supply to the timekeeping circuit 13 is stopped, and hence the internal time retained in the timekeeping circuit 13 is lost if the switch 19 is turned off. Accordingly, the power supply circuit 18 constitutes timekeeping-circuit halting means for halting an operation of the timekeeping circuit 13 based on a power supply voltage. Further, if the output voltage from the secondary battery 16 is recovered due to the power generation or the like performed by the solar battery 17, the power supply circuit 18 turns on the switch 19 to supply the power to the controller 12 and recover the function of the radio-controlled wristwatch 1. Note that when turning off the switch 19, the power supply circuit 18 sets a PB flag of a nonvolatile memory 23 described later to 1. This allows the controller 12 to detect whether or not the switch 19 has been turned off by referring to a value of the PB flag. Accordingly, the controller 12 constitutes timekeeping-circuit halt detection means for detecting that the operation of the timekeeping circuit 13 has been halted.

A switch 20 is a switch for switching on and off the power supply to the high-frequency circuit 9 and the decoding circuit 10, and is controlled by the controller 12. The high-frequency circuit 9 and the decoding circuit 10 that operate at a high frequency have large power consumption, and hence the controller 12 turns on the switch 20 to operate the high-frequency circuit 9 and the decoding circuit 10 only when the radio wave is received from the satellite, and otherwise turns off the switch 20 to reduce the power consumption.

Note that from the solar battery 17, information indicating a power generation amount thereof is input to the controller 12, which may be omitted if unnecessary.

The reception of the radio wave may be performed when the user makes a request through the input means such as the crown 4 or when a predefined time has come, or based on an elapsed time period after the time when the time is corrected previously, information indicating the power generation amount of the solar battery 17 and other ambient environmental factors of the radio-wave wristwatch 1, or the like.

The controller 12 further includes internally a memory 21, a cycle-number updating circuit 22 that constitutes cycle-number updating means, a write circuit 24 that constitutes nonvolatile memory writing means for writing to the nonvolatile memory 23, and a write inhibition circuit 25 that constitutes write inhibition means for inhibiting the writing to the nonvolatile memory 23. Operations of those circuits are described later.

Next, a description is given of the signal received from the GPS satellite by the radio-controlled wristwatch 1 according to this embodiment. The signal transmitted from the GPS satellite uses 1575.42 MHz, called the "L1 band", as a carrier frequency, and is encoded by a coarse/acquisition code inherent in each GPS satellite modulated by binary phase shift keying (BPSK) at cycles of 1.023 MHz, and multiplexed by a method of so-called code division multiple access (CDMA). The coarse/acquisition code itself is 1023-bits long, and message data added to the signal changes every 20 coarse/acquisition codes. That is, 1-bit information is transmitted as a 20-ms signal.

Figures 3, 4:
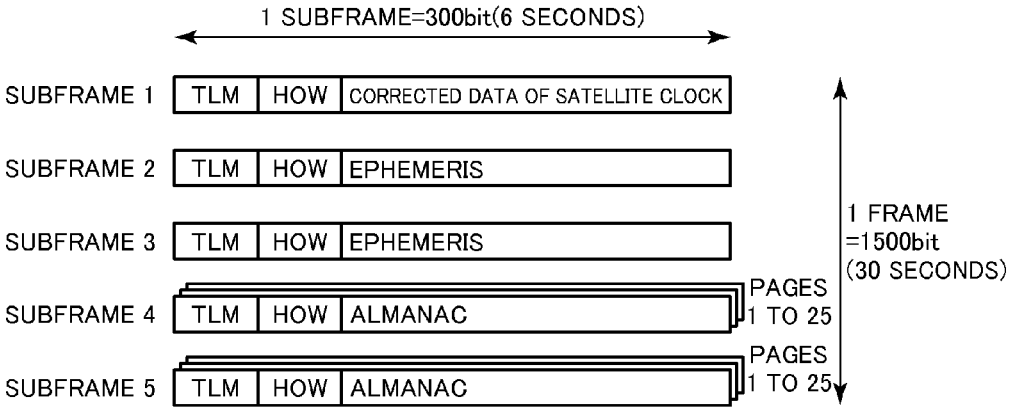
[FIG. 3] A schematic diagram illustrating structures of subframes of a signal transmitted from a GPS satellite.
[FIG. 4] A diagram illustrating the structure of a subframe 1.

The signal transmitted from the GPS satellite is divided into frames in units of 1,500 bits, that is, 30 seconds, and each of the frames is further divided into 5 subframes. FIG. 3 is a schematic diagram illustrating structures of the subframes of the signal transmitted from the GPS satellite. The subframes are each a 6-second signal including 300-bit information, and are given subframe numbers from 1 to 5 in order. The GPS satellite sequentially performs transmission from a subframe 1, and when the transmission of a subframe 5 is finished, returns to the transmission of the subframe 1 again, which is repeated in the same manner thereafter.

In a head of each of the subframes, a telemetry word represented as TLM is transmitted. TLM includes a code indicating the head of each of the subframes and information on a ground control center. Subsequently, a handover word represented as HOW is transmitted. HOW includes TOW, being information relating to the current time, which is also called "Z count". This is a 6-second-unit time counted from 0:00 a.m. on Sunday in GPS time, and indicates the time at which the subsequent subframe is started.

Information following HOW differs depending on the subframe, and the subframe 1 includes corrected data of a satellite clock.

FIG. 4 is a diagram illustrating the structure of the subframe 1 . The subframe 1 includes a week number represented by WN following HOW. WN is a numerical value indicating a current week counted by assuming Jan. 6, 1980 as a week 0. Accordingly, by receiving WN and TOW, it is possible to obtain an accurate day/time in GPS time. Note that once WN is received successfully, a correct value can be known based on the timekeeping for the internal time, unless the radio-wave wristwatch 1 loses the internal time for some reason, for example, battery exhaustion, and hence there is no need for further reception. Note that WN, which is 10-bit information as described above, returns to 0 again after the lapse of 1,024 weeks. Further, the signal received from the GPS satellite includes various other kinds of information, but pieces of information that are not directly connected to the present invention are merely illustrated in the figure, and descriptions thereof are omitted.

Returning to FIG. 3 again, a subframe 2 and a subframe 3 include orbit information on each satellite called "ephemeris" following HOW, but a description thereof is omitted herein.

In addition, subframes 4 and 5 include general orbit information for all the GPS satellites called "almanac" following HOW. The information contained in the subframes 4 and 5, which has a large information amount, is transmitted after being divided into units called "pages". The data transmitted in each of the subframes 4 and 5 is then divided into pages 1 to 25, and contents of the pages that differ depending on the frames are transmitted in order. Accordingly, 25 frames, that is 12.5 minutes, is required to transmit the contents of all the pages.

FIG. 5 is a diagram illustrating a structure of the page 18 of the subframe 4. As illustrated in the same figure, the 241st bit of the page 18 of the subframe 4 includes a current leap second $\Delta t_{LS}$ being the information relating to the current leap second. $\Delta t_{LS}$ uses the number of seconds to express a lag between a coordinated universal time (UTC) and the GPS time, and the UTC is obtained by adding $\Delta t_{LS}$ to the GPS time. The time retained by the timekeeping circuit 13 (see FIG. 2) of the radio-wave wristwatch 1 may be the GPS time, the UTC, or a standard time being the time in a specific region. The radio-wave wristwatch 1 converts the retained time into the GPS time to be used when the radio wave is received from the satellite, and converts the retained time into the standard time to be used when the time is presented to the user. In this embodiment, the radio-wave wristwatch 1 retains the internal time in UTC.

Note that as is apparent from the above description, TOW, which is included in all the subframes, can be acquired every 6 seconds, and WN, which is included in the subframe 1, can be acquired every 30 seconds, while $\Delta t_{LS}$, which is transmitted only once per 25 frames, can be acquired only every 12.5 minutes.

FIG. 6 is a diagram illustrating information retained in the memory 21 (see FIG. 2). Note that the information illustrated in the figure shows a part of the information retained in the memory 21, which does not hinder the memory 21 from further retaining other information. Note that the description is made below by referring to FIG. 2 as appropriate.

As illustrated in the same figure, the memory 21 retains $WN_{MEM}$ being the 10-bit information, $LPCNT_{MEM}$ being 3-bit information that is a cycle number of $WN_{MEM}$, and a 1-bit flag WRF indicating that the writing to the nonvolatile memory 23 is necessary. Here, $WN_{MEM}$ indicates WN retained in the memory 21, and is incremented based on the timekeeping performed by the timekeeping circuit 13 when updating $WN_{MEM}$. That is, $WN_{MEM}$ is incremented by 1 at 0:00 a.m. on Sunday in GPS time (or UTC). $LPCNT_{MEM}$ is information indicating the cycle number of $WN_{MEM}$, that is, how many times WN has caused an overflow so far. Accordingly, it is possible to know the current year and week based on $WN_{MEM}$ and $LPCNT_{MEM}$, and it is further possible to also know the accurate current year/month/day in consideration of the time information (in this case, time information within a week starting at 0:00 a.m. on Sunday) retained in the timekeeping circuit 13. Note that in this embodiment, $LPCNT_{MEM}$ is located as higher-order bits than $WN_{MEM}$, and hence $LPCNT_{MEM}$ is automatically incremented when $WN_{MEM}$ causes an overflow.

Alternatively, $WN_{MEM}$ may be updated by using the received WN when the WN received by the reception means 11 differs from $WN_{MEM}$ retained in the memory 21. Note that no difference occurs between $WN_{MEM}$ retained in the memory 21 and the received WN as long as the timekeeping circuit 13 is continuously operating, and hence $WN_{MEM}$ retained in the memory 21 may be prevented from being overwritten in order to avoid being overwritten by erroneous WN information due to erroneous reception as long as the timekeeping circuit 13 is continuously operating. Alternatively, the reception of WN may be performed again when $WN_{MEM}$ retained in the memory 21 and the received WN are different from each other, and $WN_{MEM}$ retained in the memory 21 may only be overwritten in a case where a correct WN is obtained (that is, in a case where, for example, the same WN is received two times in a row). Alternatively, $WN_{MEM}$ retained in the memory 21 may be overwritten only in a case where $WN_{MEM}$ retained in the memory 21 has been changed by the user's operation for changing the date through the crown 4 or the like.

Figure 7:
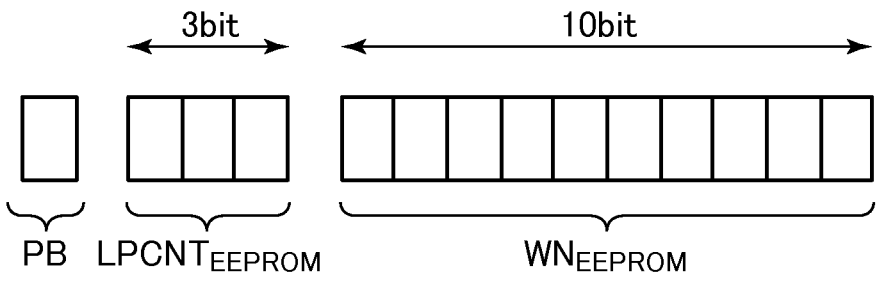
[FIG. 7] A diagram illustrating information retained in an EEPROM.

When there is an update of $WN_{MEM}$ or $LPCNT_{MEM}$, 1 is written to WRF of the memory 21. This indicates that an update is made to the information retained in the nonvolatile memory 23 described later. Note that the memory 21 is a volatile RAM in this embodiment. FIG. 7 is a diagram illustrating information retained in the nonvolatile memory 23. As illustrated in the figure, the nonvolatile memory 23 also retains $WN_{EEPROM}$ being the 10-bit information and $LPCNT_{EEPROM}$ being the 3-bit information that is the cycle number of $WN_{EEPROM}$, and those pieces of information are the same as $WN_{MEM}$ and $LPCNT_{MEM}$ retained in the memory 21. The reason for thus retaining the same information in two portions, in other words, the memory 21 and the nonvolatile memory 23, is because the memory 21, which is a volatile memory device in this embodiment, loses the information stored therein when the power supply to the controller 12 is stopped by the power supply circuit 18, and hence the nonvolatile memory 23 serves as a backup thereof. In addition, the nonvolatile memory 23 retains PB being a 1-bit flag. In this embodiment, PB whose value is 1 indicates that the operation of the timekeeping circuit 13 has been halted. Note that any device can be used as the nonvolatile memory 23, but a device that exhibits sufficiently high robustness to keep the storage information from being lost even when the power supply is stopped over as long a period as many years is desired, and in this embodiment, a metal oxide nitride oxide silicon (MONOS) type electrically erasable programmable read only memory (EEPROM) is used.

Synchronization of the information between the memory 21 and the nonvolatile memory 23 is achieved by writing the information stored in the memory 21 to the nonvolatile memory 23 at a time at which $WN_{MEM}$ (or $LPCNT_{MEM}$) within the memory 21 is updated. This operation is performed by the write circuit 24 checking the flag WRF within the memory 21 and, when the flag WRF is 1, sensing that a time to update $WN_{EEPROM}$ and $LPCNT_{EEPROM}$ has come, to write the updated $WN_{MEM}$ and $LPCNT_{MEM}$ to the nonvolatile memory 23. Note that $LPCNT_{EEPROM}$ does not always need to be written when there is no update of $LPCNT_{MEM}$ but it is preferred that the writing be performed at the time for the update of $WN_{EEPROM}$ because charges retained within the nonvolatile memory 23 are replenished, thereby increasing the robustness for retaining the information. When the writing to the nonvolatile memory 23 is finished, WRF of the memory 21 is reset to 0.

Here, a high write voltage is generally necessary for the writing to the nonvolatile memory 23, and a fixed time period is also required for the writing. When the voltage drops during the writing to cause the write voltage to become insufficient, not only is the writing not performed, but also reliability of the information retained in the nonvolatile memory 23 is impaired, which may lead to a loss of the information in the nonvolatile memory 23. Therefore, the write inhibition circuit 25 is provided for inhibiting the write circuit 24 from writing to the nonvolatile memory 23 in a case where a possibility that the writing to the nonvolatile memory 23 may fail is sensed. The write inhibition circuit 25 senses a state in which the voltage for the writing to the nonvolatile memory 23 is insufficient or a case where the write voltage may be highly likely to be insufficient during the writing, and if such a situation exists, the write circuit 24 is stopped from writing to the nonvolatile memory 23. Such a situation may arise under various conditions, and examples thereof include a case where the voltage of the secondary battery 16 has dropped and a case where other mechanisms using high power are operating or can operate. The other mechanisms using high power include the reception performed by the reception means 11, driving of a day wheel or a day-of-the-week wheel (if there is one), fast-forwarding of the hands, and driving of additional functions. The additional functions represent functions other than the timekeeping and the display of the day/time and the time, and include functions of an alarm and a stopwatch, illumination, communications, and measurement of an atmospheric pressure and a depth of water. The case where the other mechanisms using high power can operate is, for example, a case where the reception means 11 is in a standby state for performing the reception after sensing that an environment for the reception of the radio wave has been improved. It is sensed whether or not the environment for the reception of the radio wave has been improved by a method of, for example, determining that the radio-wave wristwatch 1 is outdoors by sensing the power generation amount of the solar battery 17.

In this embodiment, in a case where the possibility that writing may fail has disappeared and the inhibition of the write inhibition circuit 25 about the writing has been canceled, that is, in a case where the writing has been permitted, the write circuit 24 immediately writes to the nonvolatile memory 23 when the flag WRF of the memory 21 is 1. In other words, while the writing is inhibited by the write inhibition circuit 25, the writing to the nonvolatile memory 23 performed by the write circuit 24 is postponed. With this arrangement, the synchronization is quickly achieved between the information of the memory 21 and the information of the nonvolatile memory 23, but other than that, a time at which the write circuit 24 attempts the writing may be previously defined based on timekeeping information received from the timekeeping circuit 13, and only when the writing is permitted at such a time, the writing to the nonvolatile memory 23 may be performed. This time may be set to, for example, after 0:00 a.m. everyday or after 0:00 a.m. on Sundays.

Note that in the case where the other mechanisms using high power are operating or can operate as the case where the possibility that the writing may fail, the above-mentioned write inhibition circuit 25 may inhibit the other mechanisms using high power from operating, instead of inhibiting the write circuit 24 from writing as in this embodiment.

Next, a description is given of processing performed in a case where the power supply to the controller 12 is stopped by the power supply circuit 18 and the power supply is thereafter restarted.

If there is a period during which the power supply to the controller 12, that is, the timekeeping circuit 13, is stopped, the above-mentioned update is not made to $WN_{MEM}$. For that reason, when WN causes the overflow during such a period, $LPCNT_{MEM}$ being the cycle number of $WN_{MEM}$ cannot be updated correctly. Therefore, when the power supply circuit 18 stops the power supply, the cycle-number updating circuit 22 compares the WN received by the reception means 11 with $WN_{EEPROM}$ stored in the nonvolatile memory 23, to thereby update $LPCNT_{MEM}$ being the cycle number.

Figure 8:
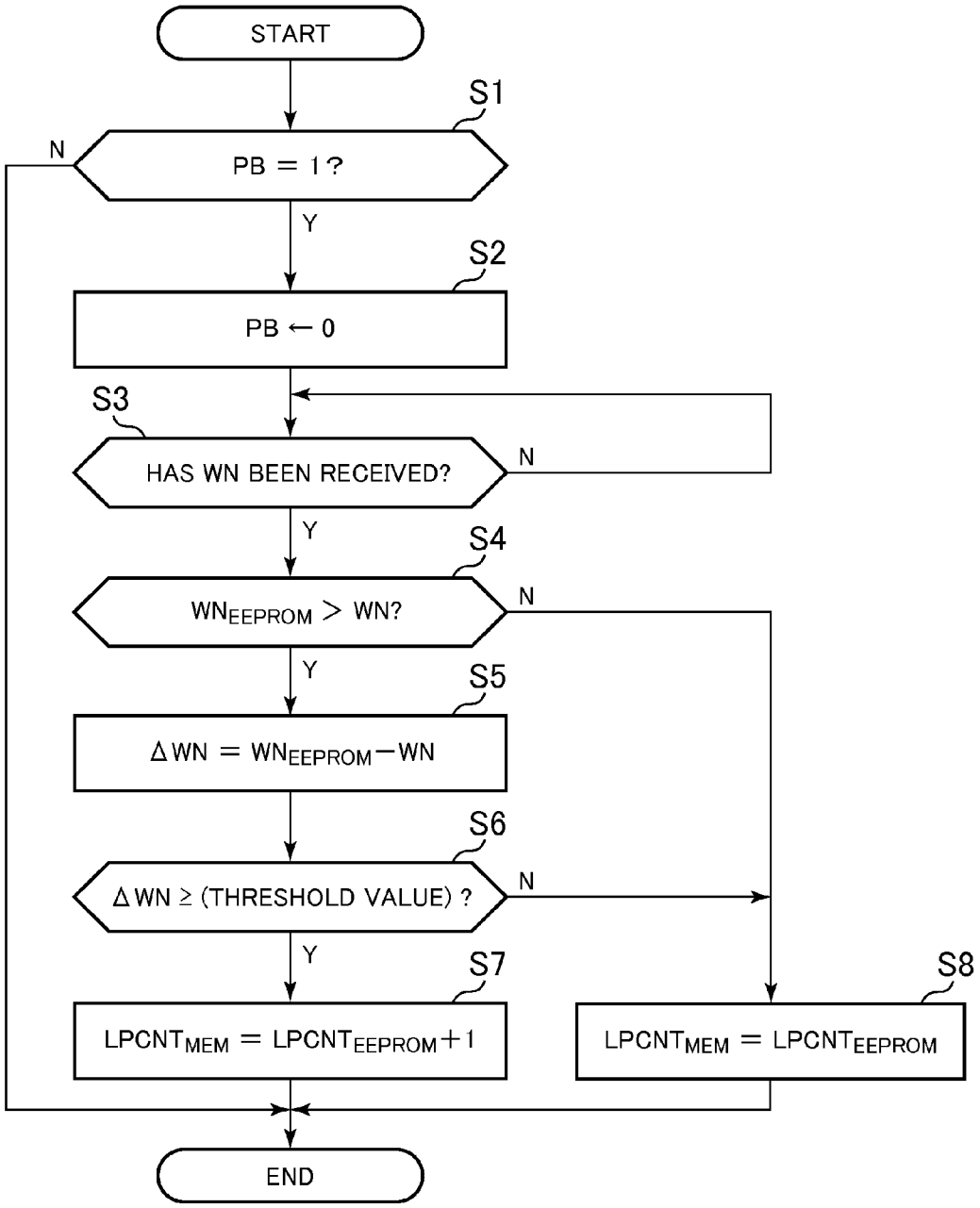
[FIG. 8] A flowchart illustrating an operation of a cycle-number updating circuit.

FIG. 8 is a flowchart illustrating an operation of the cycle-number updating circuit 22. First, in Step S1, it is determined whether or not the flag PB is 1. If PB=0, that is, the operation of the timekeeping circuit 13 is not halted by the power supply circuit 18, there is no need to update $LPCNT_{MEM}$, and the processing is brought to an end.

If PB=1, that is, the operation of the timekeeping circuit 13 has been halted by the power supply circuit 18, the procedure advances to Step S2, to set the flag PB to 0. The procedure further advances to Step S3, to determine whether or not WN has been received by the reception means 11. If WN has not been received from the satellite, the value of $WN_{MEM}$ is indeterminate, and hence the cycle-number updating circuit 22 waits until WN is received.

If WN is received, the procedure advances to Step S4, to compare the WN with $WN_{EEPROM}$. At this time, if $WN_{EEPROM}$>WN holds, that is, the value of the received WN is smaller than the value of $WN_{EEPROM}$ retained in the nonvolatile memory 23, the possibility that WN may have caused the overflow during the halt of the operation of the timekeeping circuit 13 is high. If $WN_{EEPROM}$>WN holds, the procedure advances to Step S5. Otherwise, it is assumed that WN has not caused the overflow, and the procedure advances to Step S8, to update the value of $LPCNT_{MEM}$ within the memory 21 to the value of $LPCNT_{EEPROM}$, and the processing is brought to an end.

In Step S5, a difference ΔWN between $WN_{EEPROM}$ and the WN is calculated. Subsequently, in Step S6, it is determined whether or not the value of ΔWN is equal to or larger than a predefined threshold value. If ΔWN≥(threshold value) holds, the procedure advances to Step S7, to update the cycle number, that is, update the value of $LPCNT_{MEM}$ to the value of $LPCNT_{EEPROM}$+1, and the processing is brought to an end. Otherwise, that is, if ΔWN<(threshold value) holds, the procedure advances to Step S8, to update the value of $LPCNT_{MEM}$ to the current value of $LPCNT_{EEPROM}$, and the processing is brought to an end.

Figure 9A:
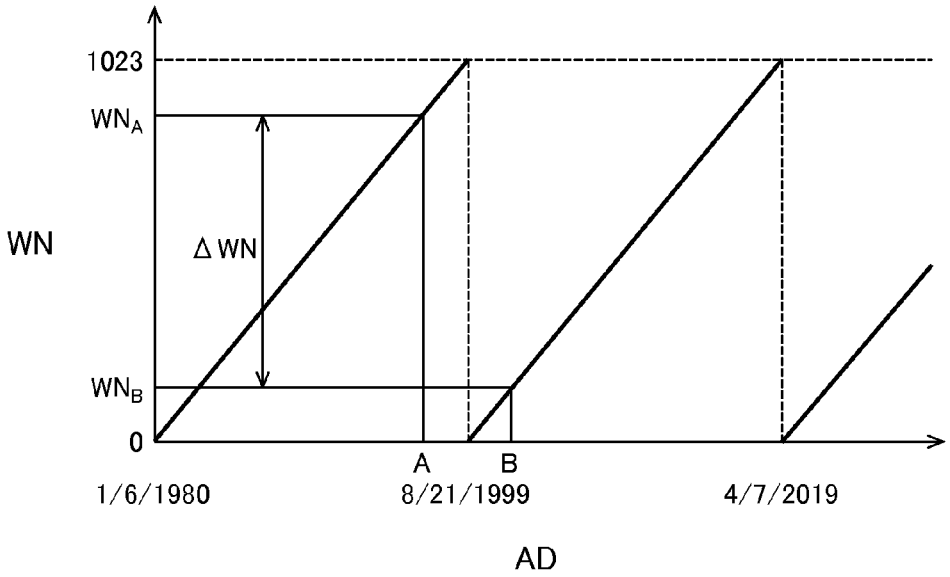
[FIG. 9A] A graph having a horizontal axis representing AD and a vertical axis representing a value of WN.
Figure 9B:
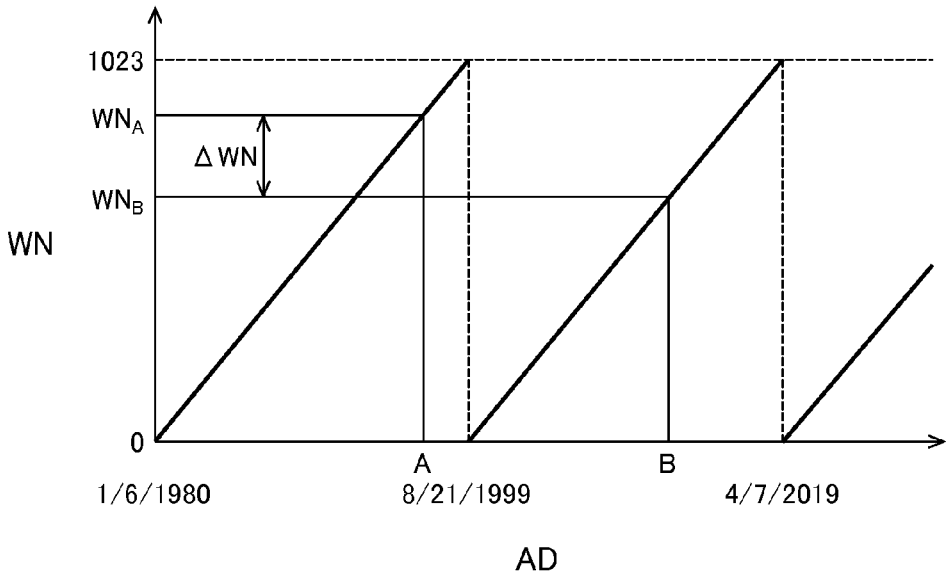
[FIG. 9B] A graph having a horizontal axis representing AD and a vertical axis representing the value of WN.

Referring to FIG. 9A and FIG. 9B, a description is given of meanings of this determination performed in Step S6. FIG. 9A and FIG. 9B are graphs having a horizontal axis representing AD and a vertical axis representing the value of WN. WN, which is the 10-bit information as described above, is incremented by 1 every week, and makes a round in 1,024 weeks. The value of WN in GPS is counted by assuming that the week to which Jan. 6, 1980 AD belongs is 0, and hence the value of WN increases as shown in FIG. 9A, and is reset to 0 on Aug. 21, 1999 and Apr. 7, 2019 due to the overflow.

Here, it is assumed that the timekeeping circuit 13 of the radio-wave wristwatch 1 is halted at a point A immediately before (for example, 1 month before) Aug. 21, 1999. At this time, the value stored in $WN_{EEPROM}$ is a value indicated by $WN_A$ in the figure. Then, if it is assumed that the timekeeping circuit 13 of the radio-wave wristwatch 1 is restarted at a point B, being a time point not long past Aug. 21, 1999, being the day on which the overflow of WN occurs (for example, 3 months after the point A), WN newly received at the point B has a value indicated by $WN_B$ in the figure. As is apparent from the figure, $WN_A$ has a value closer to 1,023, being a maximum value of WN, while $WN_B$ has a value closer to 0, and it is understood that a magnitude relationship between $WN_{EEPROM}$ (=$WN_A$) and the WN (=$WN_B$) is reversed after the overflow. At this time, a physical meaning of the difference ΔWN between $WN_{EEPROM}$ and the WN indicates that, supposing the WN has been received accurately, (1,024−ΔWN) weeks has elapsed since the week on which $WN_{EEPROM}$ is last updated until a time point at which WN is received this time.

Here, referring to FIG. 9B, consideration is given to a situation in which the timekeeping circuit 13 has been halted over a long period. In this case, a time point B at which the timekeeping circuit 13 of the radio-wave wristwatch 1 is restarted is set as a time point at which a period of many years (for example, 10 years) has elapsed since Aug. 21, 1999, being the day on which the overflow of WN occurs. At this time, as shown in the figure, $WN_B$ has a sufficiently large value, which becomes closer to $WN_A$ as the period during which the timekeeping circuit 13 is halted becomes longer, and it is understood that ΔWN is smaller than that of the above-mentioned example shown in FIG. 9A. That is, as ΔWN becomes smaller, the period during which the operation of the timekeeping circuit 13 is halted becomes longer.

However, it is not practical to assume that such a situation as shown in FIG. 9B occurs in reality. This is because it is conceivable that, in a case where the period during which the operation of the timekeeping circuit 13 is halted extends over such a long period, the secondary battery 16 cannot be recharged because of deterioration due to over discharge or change over time, or the information retained in the nonvolatile memory 23 is lost because of volatilization due to disappearance of the charges and hence the reliability cannot be guaranteed. In such a case, in reality, there is little significance in updating the value of $LPCNT_{MEM}$. This is because in the former case, it is necessary to send the radio-controlled wristwatch 1 itself to a service center or the like to replace the secondary battery 16, but at the same time, the value of $LPCNT_{MEM}$ can be updated to the correct value. Further, in the latter case, there is no meaning in setting the value of $LPCNT_{MEM}$ based on the value of $LPCNT_{EEPROM}$ having no reliability in the first place.

Regardless of such circumstances, if such a situation as shown in FIG. 9B is still detected, there is a high possibility that the erroneous reception may have been caused in the reception of WN. There is a possibility that the erroneous reception of WN may be caused for each of the bits thereof, but consideration is given to a possibility that, supposing a given bit among the 10 bits of WN has been erroneously received, the value of $LPCNT_{MEM}$ may be erroneously updated thereby. The update of the value of $LPCNT_{MEM}$ due to such erroneous reception can happen if Step S4 of FIG. 8 results in yes, that is, an arbitrary bit among the 10 bits of WN has been erroneously received as having the value of 0 instead of being 1. That is, as shown in FIG. 9B, if it is detected that the magnitude relationship between $WN_{EEPROM}$ (=$WN_A$) and WN (=$WN_B$) is reversed in the situation that can hardly happen in reality, it is conceivable that the detection is performed because WN has been erroneously received.

Accordingly, instead of updating the value of $LPCNT_{MEM}$ even in such a case, the value of $LPCNT_{MEM}$ may be inhibited from being updated, to thereby reduce the possibility that the value of $LPCNT_{MEM}$ may be erroneously updated due to the erroneous reception. For example, in a case where 768 (in binary notation, 1100000000) is selected as the threshold value of ΔWN, when higher-order 2 bits of WN are erroneously received, the value of $LPCNT_{MEM}$ is not updated. In this case, the possibility that the value of $LPCNT_{MEM}$ may be updated due to the erroneous reception becomes as low as 80% compared to a case where the determination is not performed in Step S6. In this case, if the period during which the operation of the timekeeping circuit 13 is halted is within 1024−768=256 weeks (approximately 4.7 years), the value of $LPCNT_{MEM}$ can be updated when the power supply voltage rises again. If this threshold value is set to a larger value, for example, 896 (in binary notation, 1110000000), the possibility that $LPCNT_{MEM}$ may be erroneously updated becomes as low as 70%, and if the period during which the operation of the timekeeping circuit 13 is halted is within 1024−896=128 weeks (approximately 2.4 years), the value of $LPCNT_{MEM}$ can be updated when the power supply voltage rises again. Such a threshold value may be specifically defined based on the secondary battery 16 and an information retention characteristic of the nonvolatile memory 23. Further, the radio-controlled wristwatch 1 may be configured to include a plurality of threshold values and to select the threshold value depending on the type of the secondary battery 16.

Note that in a case where the possibility that $LPCNT_{MEM}$ may be erroneously updated due to the erroneous reception is low or can be ignored, the processing of Steps S5 and S6 of FIG. 8 is unnecessary, and therefore may be omitted.

Further, if the value of $LPCNT_{MEM}$ is written in Steps S7 and S8 of FIG. 8, the value of the flag WRF becomes 1 (see FIG. 6), and hence the value of $LPCNT_{MEM}$ is further written to the nonvolatile memory 23 at the above-mentioned appropriate time.

In the embodiment described above, the write inhibition circuit 25 illustrated in FIG. 2 inhibits the write circuit 24 from writing in the case where the possibility that the writing to the nonvolatile memory 23 may fail is sensed. In addition, the reduction in the power supply voltage, that is, the voltage of the secondary battery 16 is exemplified as a representative case where there is a possibility that the writing to the nonvolatile memory 23 may fail.

Here, it is conceivable that the state in which the voltage of the secondary battery 16 has dropped is a state in which the radio-controlled wristwatch 1 is left standing without being charged by the solar battery 17, and there is a high possibility that the voltage may continue dropping as it is and that the power supply to the controller 12 may be stopped by the power supply circuit 18. In this case, $LPCNT_{MEM}$ and $WN_{MEM}$ updated on the memory 21 are finally lost without being written to the nonvolatile memory 23.

However, when the output voltage from the secondary battery 16 is recovered and when WN is received from the satellite, $WN_{MEM}$ is correctly updated by the received WN, and $LPCNT_{MEM}$ is correctly updated by the cycle-number updating circuit 22. That is, the write inhibition circuit 25 inhibits $LPCNT_{MEM}$ from being backed up to the nonvolatile memory 23, but the existence of the cycle-number updating circuit 22 allows $LPCNT_{MEM}$ to be updated to a correct value even if the updated $LPCNT_{MEM}$ cannot be backed up.

Incidentally, as described above, the leap second $\Delta t_{LS}$, which is the information included only in the page 18 of the subframe 4 within the signal received from the GPS satellite, can be transmitted only once per 12.5 minutes, and is therefore hard to acquire through the reception requested by the user or automatic reception that does not take the time to transmit the leap second $\Delta t_{LS}$ into consideration. Accordingly, in a situation in which the leap second $\Delta t_{LS}$ is to be acquired, for example, a situation in which a predetermined period (for example, 6 months) has elapsed since the last reception of the leap second $\Delta t_{LS}$ or the timekeeping circuit 13 has been halted, the reception needs to be performed by predicting a time at which the leap second $\Delta t_{LS}$ is transmitted. However, this time cannot be predicted simply from an accurate current GPS time, that is, the time converted from WN and TOW. This is because the 25 pages included in the signal received from the GPS satellite has repeatedly made a round without being synchronized with WN (that is, without the overflow of WN being taken into consideration) since 0:00 a.m. on Jan. 6, 1980, when the transmission of the GPS signal was started, and hence the current cycle number of WN needs to be known in order to know the time at which the leap second $\Delta t_{LS}$ is transmitted.

Therefore, in the radio-wave wristwatch 1 according to this embodiment, the controller 12 refers to $LPCNT_{MEM}$ being the cycle number of the day-related information to predict the time at which the leap second $\Delta t_{LS}$ is transmitted, and starts up the reception means 11 to receive the leap second $\Delta t_{LS}$ being the information relating to the leap second. Specifically, $WN_{ACC}$ being a week number accumulated since the transmission of the GPS signal was started can be obtained as:

$$WN_{ACC}=1024\times LPCNT_{MEM}+WN_{MEM},$$

and the time at which the leap second $\Delta t_{LS}$ is transmitted can be accurately predicted from a time accumulated since the transmission of the GPS signal was started obtained by adding the current time thereto.

Specific configurations illustrated in the embodiment described above are merely examples, and various changes can be made by a person skilled in the art. For example, the functional blocks are not necessarily the same as those illustrated in the figure as long as the same functions can be obtained. Further, the flowchart is not necessarily the same as the one illustrated in the figure as long as it has an algorithm that can achieve the same functions.

Note that from a viewpoint according to the embodiment of the present invention, the cycle-number updating means updates the cycle number of the day-related information when a difference between the day-related information stored in the nonvolatile memory and the day-related information extracted by the reception means is equal to or larger than a predefined value, and inhibits the cycle number of the day-related information from being updated when the difference is smaller than the predefined value.

With such a configuration, a fear that the cycle number may be erroneously updated due to the erroneous reception is reduced.

Further, from another viewpoint according to the embodiment of the present invention, the radio-controlled wristwatch further includes nonvolatile memory writing means for sensing a time to update the day-related information and the cycle number of the day-related information based on timekeeping performed by the timekeeping circuit, and writing the day-related information and the cycle number of the day-related information, which have been updated, to the nonvolatile memory.

With such a configuration, even without the reception of the radio wave from the satellite, the day-related information and the cycle number of the day-related information are updated based on the timekeeping performed by the timekeeping circuit.

Further, from yet another viewpoint according to the embodiment of the present invention, the radio-controlled wristwatch further includes write inhibition means for inhibiting the nonvolatile memory writing means from writing to the nonvolatile memory in a case where a possibility that writing performed by the nonvolatile memory writing means fails is sensed.

With such a configuration, the information retained in the nonvolatile memory can be prevented from disappearing due to the insufficient write voltage at the time of the writing to the nonvolatile memory, and even when the operation of the timekeeping circuit is halted without writing, the cycle number of the day-related information can be correctly updated by receiving the radio wave from the satellite after the power supply voltage is recovered.

Further, from still another viewpoint according to the embodiment of the present invention, the write inhibition means postpones the writing to the nonvolatile memory performed by the nonvolatile memory writing means in the case where the possibility that the writing fails is sensed, and permits the writing to the nonvolatile memory performed by the nonvolatile memory writing means in a case where the possibility that the writing fails has disappeared.

With such a configuration, the information retained in the nonvolatile memory can be maintained up-to-date to a maximum extent.

Further, from still another viewpoint according to the embodiment of the present invention, the case where the possibility that the writing fails is sensed includes at least one of the reduction in the power supply voltage, the reception of the radio wave from the satellite performed by the reception means, the driving of the day wheel, the fast-forwarding of the hand, the driving of the additional function, and the standby state for the reception of the radio wave from the satellite performed by the reception means.

With such a configuration, the information retained in the nonvolatile memory can be prevented from disappearing not only in the case of reduction in the power supply voltage but also in the case of temporary reduction in the voltage due to use of high power.

Further, from still another viewpoint according to the embodiment of the present invention, the reception means receives information relating to a leap second at a time predicted by referring to the cycle number of the day-related information.

With such a configuration, a time to transmit the information relating to the leap second can be accurately predicted, and the information relating to the leap second can be received without depending on the cycle number of the day-related information.

The invention claimed is:

1. A radio-controlled wristwatch, comprising:

reception means for receiving a radio wave from a satellite and extracting day-related information therefrom;

timekeeping-circuit halting means for halting an operation of a timekeeping circuit based on a power supply voltage;

timekeeping-circuit halt detection means for detecting that the operation of the timekeeping circuit has been halted by the timekeeping-circuit halting means;

a nonvolatile memory for storing the day-related information and a cycle number of the day-related information; and cycle-number updating means for comparing, when the timekeeping-circuit halt detection means detects that the operation of the timekeeping circuit has been halted, the day-related information extracted by the reception means and the day-related information stored in the nonvolatile memory to each other, and updating the cycle number of the day-related information when the day-related information stored in the nonvolatile memory is larger than the day-related information extracted by the reception means.

2. The radio-controlled wristwatch according to claim 1, wherein the cycle-number updating means updates the cycle number of the day-related information when a difference between the day-related information stored in the nonvolatile memory and the day-related information extracted by the reception means is equal to or larger than a predefined value, and inhibits the cycle number of the day-related information from being updated when the difference is smaller than the predefined value.

3. The radio-controlled wristwatch according to claim 1, further comprising nonvolatile memory writing means for sensing a time to update the day-related information and the cycle number of the day-related information based on timekeeping performed by the timekeeping circuit, and writing the day-related information and the cycle number of the day-related information, which have been updated, to the nonvolatile memory.

4. The radio-controlled wristwatch according to claim 3, further comprising write inhibition means for inhibiting the nonvolatile memory writing means from writing to the nonvolatile memory in a case where a possibility that writing performed by the nonvolatile memory writing means fails is sensed.

5. The radio-controlled wristwatch according to claim 4, wherein the write inhibition means postpones the writing to the nonvolatile memory performed by the nonvolatile memory writing means in the case where the possibility that the writing fails is sensed, and permits the writing to the nonvolatile memory performed by the nonvolatile memory writing means in a case where the possibility that the writing fails has disappeared.

6. The radio-controlled wristwatch according to claim 4, wherein the case where the possibility that the writing fails is sensed comprises at least one of reduction in the power supply voltage, reception of the radio wave from the satellite performed by the reception means, driving of a day wheel, fast-forwarding of a hand, driving of an additional function, and a standby state for the reception of the radio wave from the satellite performed by the reception means.

7. The radio-controlled wristwatch according to claim 1, wherein the reception means receives information relating to a leap second at a time predicted by referring to the cycle number of the day-related information.

8. The radio-controlled wristwatch according to claim 2, further comprising nonvolatile memory writing means for sensing a time to update the day-related information and the cycle number of the day-related information based on timekeeping performed by the timekeeping circuit, and writing the day-related information and the cycle number of the day-related information, which have been updated, to the nonvolatile memory.

9. The radio-controlled wristwatch according to claim 8, further comprising write inhibition means for inhibiting the nonvolatile memory writing means from writing to the nonvolatile memory in a case where a possibility that writing performed by the nonvolatile memory writing means fails is sensed.

10. The radio-controlled wristwatch according to claim 9, wherein the write inhibition means postpones the writing to the nonvolatile memory performed by the nonvolatile memory writing means in the case where the possibility that the writing fails is sensed, and permits the writing to the nonvolatile memory performed by the nonvolatile memory writing means in a case where the possibility that the writing fails has disappeared.

11. The radio-controlled wristwatch according to claim 5, wherein the case where the possibility that the writing fails is sensed comprises at least one of reduction in the power supply voltage, reception of the radio wave from the satellite performed by the reception means, driving of a day wheel, fast-forwarding of a hand, driving of an additional function, and a standby state for the reception of the radio wave from the satellite performed by the reception means.

12. The radio-controlled wristwatch according to claim 9, wherein the case where the possibility that the writing fails is sensed comprises at least one of reduction in the power supply voltage, reception of the radio wave from the satellite performed by the reception means, driving of a day wheel, fast-forwarding of a hand, driving of an additional function, and a standby state for the reception of the radio wave from the satellite performed by the reception means.

13. The radio-controlled wristwatch according to claim 10, wherein the case where the possibility that the writing fails is sensed comprises at least one of reduction in the power supply voltage, reception of the radio wave from the satellite performed by the reception means, driving of a day wheel, fast-forwarding of a hand, driving of an additional function, and a standby state for the reception of the radio wave from the satellite performed by the reception means.

* * * * *